US010053123B2

(12) United States Patent
Morita et al.

(10) Patent No.: US 10,053,123 B2
(45) Date of Patent: Aug. 21, 2018

(54) SERVICE MANAGEMENT DEVICE, TRAIN CONTROL METHOD, AND PROGRAM

(71) Applicant: MITSUBISHI HEAVY INDUSTRIES, LTD., Tokyo (JP)

(72) Inventors: Katsuaki Morita, Tokyo (JP); Hiroyuki Kono, Tokyo (JP); Masaya Mitake, Tokyo (JP); Atsuyoshi Saimen, Tokyo (JP); Yasuyuki Suzuki, Tokyo (JP)

(73) Assignee: MITSUBISHI HEAVY INDUSTRIES, LTD., Tokyo (JP)

( * ) Notice: Subject to any disclaimer, the term of this patent is extended or adjusted under 35 U.S.C. 154(b) by 163 days.

(21) Appl. No.: 15/126,574

(22) PCT Filed: Dec. 18, 2014

(86) PCT No.: PCT/JP2014/083604

§ 371 (c)(1),
(2) Date: Sep. 15, 2016

(87) PCT Pub. No.: WO2015/145900

PCT Pub. Date: Oct. 1, 2015

(65) Prior Publication Data

US 2017/0080963 A1 Mar. 23, 2017

(30) Foreign Application Priority Data

Mar. 25, 2014 (JP) ..... 2014-061916

(51) Int. Cl.
*B61L 27/00* (2006.01)

(52) U.S. Cl.
CPC ..... *B61L 27/0027* (2013.01); *B61L 27/0077* (2013.01); *B61L 27/0088* (2013.01)

(58) Field of Classification Search
CPC .. B61L 27/00; B61L 27/0027; B61L 27/0077; B61L 27/0088
See application file for complete search history.

(56) References Cited

U.S. PATENT DOCUMENTS

2007/0219683 A1* 9/2007 Daum ..... B61L 3/006 701/19
2007/0233364 A1* 10/2007 Kumar ..... B61L 3/006 701/123

(Continued)

FOREIGN PATENT DOCUMENTS

JP 6-138822 A 5/1994
JP 9-76912 A 3/1997

(Continued)

OTHER PUBLICATIONS

International Search Report in PCT Application No. PCT/JP2014/083604, dated Jan. 20, 2015.

(Continued)

*Primary Examiner* — Jason C Smith
(74) *Attorney, Agent, or Firm* — Kanesaka Berner and Partners LLP

(57) ABSTRACT

A valid cars determining unit determines the number of valid cars of each train such that a passenger transport volume per unit time of a plurality of trains is not less than a necessary transport volume and the total number of valid cars is minimized when the plurality of trains run with a predetermined number of operational cars per unit time. A control information generating unit generates control information for performing control which causes trains having valid cars corresponding to the number of valid cars determined by the valid cars determining unit to operate at a predetermined interval.

9 Claims, 6 Drawing Sheets

(56) References Cited

U.S. PATENT DOCUMENTS

| | | | | |
|---|---|---|---|---|
| 2008/0167767 | A1* | 7/2008 | Brooks | B61L 3/006 701/20 |
| 2009/0187291 | A1* | 7/2009 | Daum | B61L 3/006 701/2 |
| 2010/0023190 | A1* | 1/2010 | Kumar | B61L 3/006 701/20 |
| 2010/0168942 | A1* | 7/2010 | Noffsinger | B61L 3/006 701/21 |
| 2013/0131909 | A1* | 5/2013 | Cooper | B61L 27/0011 701/23 |
| 2016/0159237 | A1* | 6/2016 | Morita | H02J 7/04 320/162 |
| 2016/0200203 | A1* | 7/2016 | Morita | B60L 3/0069 701/22 |
| 2016/0231389 | A1* | 8/2016 | Wakasugi | H01M 10/48 |
| 2017/0072974 | A1* | 3/2017 | Morita | B61L 3/006 |
| 2017/0080963 | A1* | 3/2017 | Morita | B61L 27/0027 |

FOREIGN PATENT DOCUMENTS

| | | | |
|---|---|---|---|
| JP | 2002-205648 | A | 7/2002 |
| JP | 2003-285637 | A | 10/2003 |
| JP | 2012-153313 | A | 8/2012 |
| JP | 2012-162209 | A | 8/2012 |

OTHER PUBLICATIONS

Written Opinion in PCT Application No. PCT/JP2014/083604, dated Jan. 20, 2015.

* cited by examiner

SERVICE MANAGEMENT DEVICE, TRAIN CONTROL METHOD, AND PROGRAM

RELATED APPLICATIONS

The present application is a National Phase of PCT/JP2014/083604, filed Dec. 18, 2014, and claims priority based on Japanese Patent Application No. 2014-061916, filed Mar. 25, 2014.

TECHNICAL FIELD

The present invention relates to a service management device, a train control method, and a program.

BACKGROUND ART

Patent Literature 1 discloses a technique of acquiring the numbers of passengers of stations using a ticket reading function of automatic ticket gates and editing an optimal operation schedule. According to Patent Literature 1, a schedule editing device calculates the number of times trains operate such that a train occupancy approaches a predetermined target train occupancy for each time zone on the basis of entrance information acquired from automatic ticket gates of stations.

CITATION LIST

Patent Literature

[Patent Literature 1]
Japanese Unexamined Patent Application, First Publication No. H6-138822

SUMMARY OF INVENTION

Technical Problem

In the method described in Patent Literature 1, the number of times trains operate is made to approach a target train occupancy. Accordingly, in a time zone in which the number of passengers is small, the number of times the trains operate in the time zone decreases. In this case, train operation efficiency is apparently improved. However, since a train waiting time increases, convenience to passengers decreases.

The present invention provides a service management device, a train control method, and a program that can improve train operation efficiency without damaging passenger convenience.

Solution to Problem

A service management device according to a first aspect of the present invention includes a valid cars determining unit and a control information generating unit. The valid cars determining unit determines the number of valid cars of each train when a plurality of trains having one or more cars run with a predetermined number of operational cars per unit time. The valid cars determining unit determines the number of valid cars of each train such that a passenger transport volume per unit time of the plurality of trains is not less than a necessary transport volume and the total number of valid cars is minimized. The control information generating unit generates control information for performing control which causes trains having valid cars corresponding to the number of valid cars determined by the valid cars determining unit to operate at a predetermined interval.

A second aspect of the present invention provides the service management device according to the first aspect further including an operational cars determining unit that determines the number of operational cars per unit time on the basis of the necessary transport volume, wherein the valid cars determining unit determines the number of valid cars of each train on the basis of the number of operational cars which is determined by the operational cars determining unit.

A third aspect of the present invention provides the service management device according to the second aspect, wherein the operational cars determining unit determines the number of operational cars to be a predetermined minimum value or more.

A fourth aspect of the present invention provides the service management device according to any one of the first to third aspects further including a necessary transport volume specifying unit that specifies the necessary transport volume on the basis of data associated with a previous operation.

According to a fifth aspect of the present invention, the service management device according to any one of the first to fourth aspects further includes: an index value specifying unit, a time zone changing unit, and an operating plan determining unit. The valid cars determining unit determines the number of valid cars of the trains operating for each predetermined time zone. The control information generating unit generates control information for performing control which causes the trains having the valid cars corresponding to the number of valid cars determined by the operating plan determining unit to operate at the predetermined interval. The index value specifying unit specifies an index value which increases as energy consumption increases when the trains run and which increases as a changing frequency of the number of valid cars increases on the basis of the number of valid cars determined by the valid cars determining unit. The time zone changing unit changes a length of the time zone. The operating plan determining unit determines the number of valid cars of each train to be the number of valid cars in which the index value is smallest.

A sixth aspect of the present invention provides the service management device according to any one of the first to fifth aspects, wherein the valid cars determining unit determines the number of valid cars of each train from a predetermined valid car pattern.

According to a seventh aspect of the present invention, there is provided a train control method including: a step of determining the number of valid cars of each train such that a passenger transport volume per unit time of a plurality of trains is not less than a necessary transport volume and the total number of valid cars is minimized when a plurality of trains having one or more cars run with a predetermined number of operational cars per unit time; and a step of causing trains having valid cars corresponding to the determined number of valid cars to operate at a predetermined interval.

An eight aspect of the present invention provides the train control method according to the seventh aspect further including a step of stopping an auxiliary device of a car other than the valid cars in the train having more than the determined number of valid cars.

A program according to a ninth aspect of the present invention causes a computer to serve as: a valid cars determining unit and a control information generating unit. The valid cars determining unit determines the number of valid cars of each train when a plurality of trains having one or more cars run with a predetermined number of operational cars per unit time. The valid cars determining unit determines the number of valid cars of each train such that a passenger transport volume per unit time of the plurality of trains is not less than a necessary transport volume and the total number of valid cars is minimized. The control information generating unit generates control information for performing control which causes trains having valid cars corresponding to the number of valid cars determined by the valid cars determining unit to operate at a predetermined interval.

Advantageous Effects of Invention

According to at least one of the aspects, the service management device determines the number of valid cars of each train such that a passenger transport volume per unit time is not less than a necessary transport volume and the total number of valid cars is minimized. Accordingly, it is possible to improve train operation efficiency without damaging passenger convenience.

DESCRIPTION OF EMBODIMENTS

First Embodiment

[Overview]

Hereinafter, embodiments will be described in detail with reference to the accompanying drawings.

Figure 1:
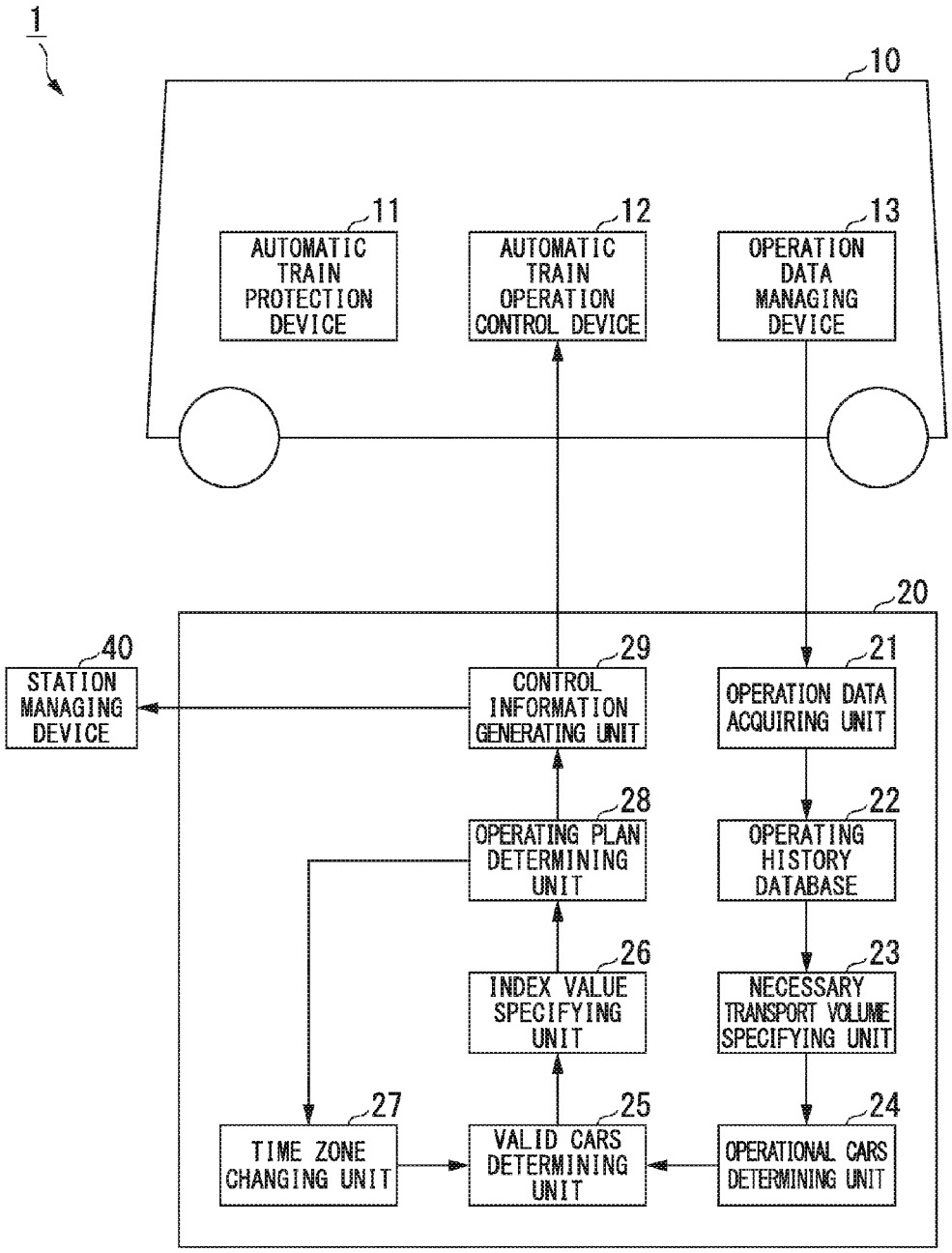
FIG. 1 is a schematic block diagram illustrating a configuration of a transport system according to a first embodiment.

FIG. 1 is a schematic block diagram illustrating a configuration of a transport system 1 according to a first embodiment.

The transport system 1 according to this embodiment includes a plurality of trains 10, a service management device 20, and a station managing device 40. The trains 10 operate on a track. The service management device 20 manages the operation of the trains 10. The station managing device 40 manages information of stations on the track. A plurality of stations are arranged on the track. Each station is provided with the station managing device 40. The trains 10 stop at each station. Passengers board or alight from the trains 10 at each station.

The trains 10 operate with power supplied from an aerial wire. Each train 10 includes a plurality of cars. A passenger transport capacity of each train 10 increases as the number of cars increases. On the other hand, power consumption necessary to operate each train 10 increases as the number of cars increases.

The transport system 1 according to this embodiment includes trains 10 of two types of two cars and four cars as the number of operational cars. That is, valid car patterns according to this embodiment are the two types of two cars and four cars. Trains that do not operate among the trains 10 of the transport system 1 are stored in a garage of an originating station on the track.

The transport system 1 according to the first embodiment determines the number of operational cars of the trains 10 for each time zone such that an operating interval of the trains 10 is normally equal to or less than a minimum operating interval. Accordingly, the transport system 1 can suppress waiting times of passengers to be less than the minimum operating interval. As a result, the transport system 1 can prevent damage to passenger convenience. The transport system 1 determines the number of operational cars (the number of valid cars) of each train 10 such that a passenger transport volume is not less than a necessary transport volume on the basis of the determined number of operational cars. A valid car is a car which can be used by passengers. The transport system 1 determines the number of operational cars of each train 10 such that the total number of operational cars is minimized. Accordingly, it is possible to improve operation efficiency of the trains 10.

Configurations of the train 10 and a service management device 20 according to the first embodiment will be described below.

[Configuration of Train 10]

The train 10 includes an automatic train protection (ATP) device 11, an automatic train operation (ATO) control device 12, and an operation data managing device 13.

The ATP device 11 is a device that automatically stops or decelerates the train 10 when the train 10 tries to move past a stop signal or when the speed of the train 10 is higher than a predetermined speed.

The ATO control device 12 causes the train 10 to operate in an operating mode acquired from the service management device 20.

The operation data managing device 13 collects data associated with the operation of the train 10 and transmits the data associated with the operation of the train 10 to the service management device 20. The data associated with the operation of the train 10 includes, for example, a stopped-train occupancy of the station, a departing-train occupancy of the station, a boarding and alighting time, and a stopping time for each station.

The ATP device 11 and the ATO control device 12 specify a position of the train 10. The ATP device 11 and the ATO control device 12 control a speed of the train 10 on the basis of the specified position. The ATP device 11 and the ATO control device 12 specify the position of the train 10 by communicating with a ground unit installed on the ground. The ground unit transmits information indicating a position at which the ground unit is installed and information of a speed limit.

[Configuration of Service Management Device 20]

The service management device 20 includes an operation data acquiring unit 21, an operating history database 22, a necessary transport volume specifying unit 23, an operational cars determining unit 24, a valid cars determining unit 25, an index value specifying unit 26, a time zone changing unit 27, an operating plan determining unit 28, and a control information generating unit 29. The service management device 20 generates an operating plan of a day. The service management device 20 transmits departure times associated with the operating plan to each train 10.

The operation data acquiring unit 21 collects data associated with the operation of each train 10 from the operation data managing device 13 of the train 10. The operation data acquiring unit 21 writes the collected data to the operating history database 22.

The operating history database 22 stores data associated with a previous operation of the train 10. The operating history database 22 stores a date, a day of the week, information indicating whether the day is a holiday, information of an event of the day, time, station names, a moving direction, a stopped-train occupancy of the station, a departing-train occupancy of the station, a boarding and alighting time, and a stopping time at the station in correlation with each other. Among these, the time, the station names, the stopped-train occupancy of the station, the departing-train occupancy of the station, the boarding and alighting time, and the stopping time at the station are information transmitted from the operation data managing device 13.

The necessary transport volume specifying unit 23 specifies a necessary transport volume for each time zone and for each station on the basis of the information stored in the operating history database 22. The necessary transport volume is specified, for example, on the basis of time zones for each time required to allow the train 10 to circulate on the track. The necessary transport volume specifying unit 23 predicts the necessary transport volume on the basis of, for example, a Bayesian model, a K-means algorithm, or another prediction algorithm. An example of the method of specifying a necessary transport volume is a method of causing the necessary transport volume specifying unit 23 to predict the number of passengers for each time zone for each station and to specify a maximum value of the number of passengers at one station in a certain time zone as the necessary transport volume in the time zone.

The operational cars determining unit 24 determines the number of operational cars of each train 10 for each time zone on the basis of the necessary transport volume specified by the necessary transport volume specifying unit 23. Specifically, the operational cars determining unit 24 evaluates a transport capacity required for the time zone by three steps on the basis of the necessary transport volume specified by the necessary transport volume specifying unit 23.

The steps of the transport capacity in this embodiment include three steps of "off-peak transport capacity," "normal transport capacity," and "peak transport capacity." The "off-peak transport capacity" is a transport capacity which is applied when the necessary transport volume is relatively small (for example, less than 7000 passengers per hour per direction (pphpd)). For example, in a time zone corresponding to the "off-peak transport capacity," the operational cars determining unit 24 determines the number of operational cars to be 28 and determines an operating interval of the trains 10 to be 200 seconds to realize a passenger transport volume of 7000 pphpd. The "normal transport capacity" is a transport capacity which is applied when the necessary transport volume is intermediate (for example, 7000 pphpd or more and less than 10000 pphpd). The number of operational cars of 28 is a minimum value of the number of operational cars in this embodiment. For example, in a time zone corresponding to the "normal transport capacity," the operational cars determining unit 24 determines the number of operational cars to be 39 and determines the operating interval of the trains 10 to be 140 seconds to realize a passenger transport volume of 10000 pphpd. The "peak transport capacity" is a transport capacity which is applied when the necessary transport volume is relatively great (for example, 10000 pphpd or more). For example, in a time zone corresponding to the "peak transport capacity," the operational cars determining unit 24 determines the number of operational cars to be 50 and determines the operating interval of the trains 10 to be 110 seconds to realize a passenger transport volume of 14000 pphpd. The passenger transport volume associated with the transport capacity is calculated on the premise that all trains 10 are set to have four cars (a maximum number of operational cars in the transport system 1).

The valid cars determining unit 25 determines the number of valid cars of each train 10 when the trains 10 run with the number of operational cars determined by the operational cars determining unit 24. The valid cars determining unit 25 determines the number of valid cars of each train 10 such that the passenger transport volume per unit time is not less than the necessary transport volume and the total number of valid cars is a minimum. Specifically, when the number of trains 10 having four cars is defined as x and the number of trains 10 having two cars is defined as y, the valid cars determining unit 25 specifies x and y which satisfy Equation (1) and in which the number of trains x is a minimum (the number of trains y is a maximum) Here, x and y are integers equal to or greater than 0.

[Math. 1]

$$\left[\begin{array}{c} \dfrac{f \times (4x + 2y)}{c} \times \dfrac{3600}{h} \geq p \\ x + y = c \end{array}\right. \tag{1}$$

Here, f denotes a maximum number of passengers for each car, c denotes the number of operational cars determined by the operational cars determining unit 24, h denotes the operating interval determined by the operational cars determining unit 24, and p denotes the necessary transport volume.

The index value specifying unit 26 calculates an index value of an operating plan on the basis of total power consumption (total energy consumption) when the trains 10 having the number of valid cars determined by the valid cars determining unit 25 operate with the number of operational cars determined by the operational cars determining unit 24, an operational complexity index, and a passenger convenience index. The operational complexity index is a value indicating an operational complexity associated with the operation of the trains 10. The operational complexity index increases as the changing frequency of the number of valid cars increases. The passenger convenience index is a value indicating convenience of the transport system 1 to passengers when the corresponding operating plan is employed. The passenger convenience index increases as the train occupancy or the waiting time increases.

The time zone changing unit 27 changes a length of a time zone which is used for the valid cars determining unit 25 to determine the number of valid cars. The length of a time zone is preferably an integer multiple of a time required for the train 10 to circulate on the track.

The operating plan determining unit 28 employs an operating plan associated with a minimum index value calculated on the basis of time zones having different lengths as the operating plan of the trains 10 of the day.

The control information generating unit 29 generates control information for performing control which causes the trains 10 having valid cars corresponding to the number of valid cars associated with the operating plan employed by the operating plan determining unit 28 to operate at a predetermined interval. The control information generating unit 29 transmits the control information to the ATO control device 12 of each of the trains 10 and the station managing device 40 of each of the stations.

[Operation]

An operation of the service management device 20 according to this embodiment will be described below.

Figure 2:
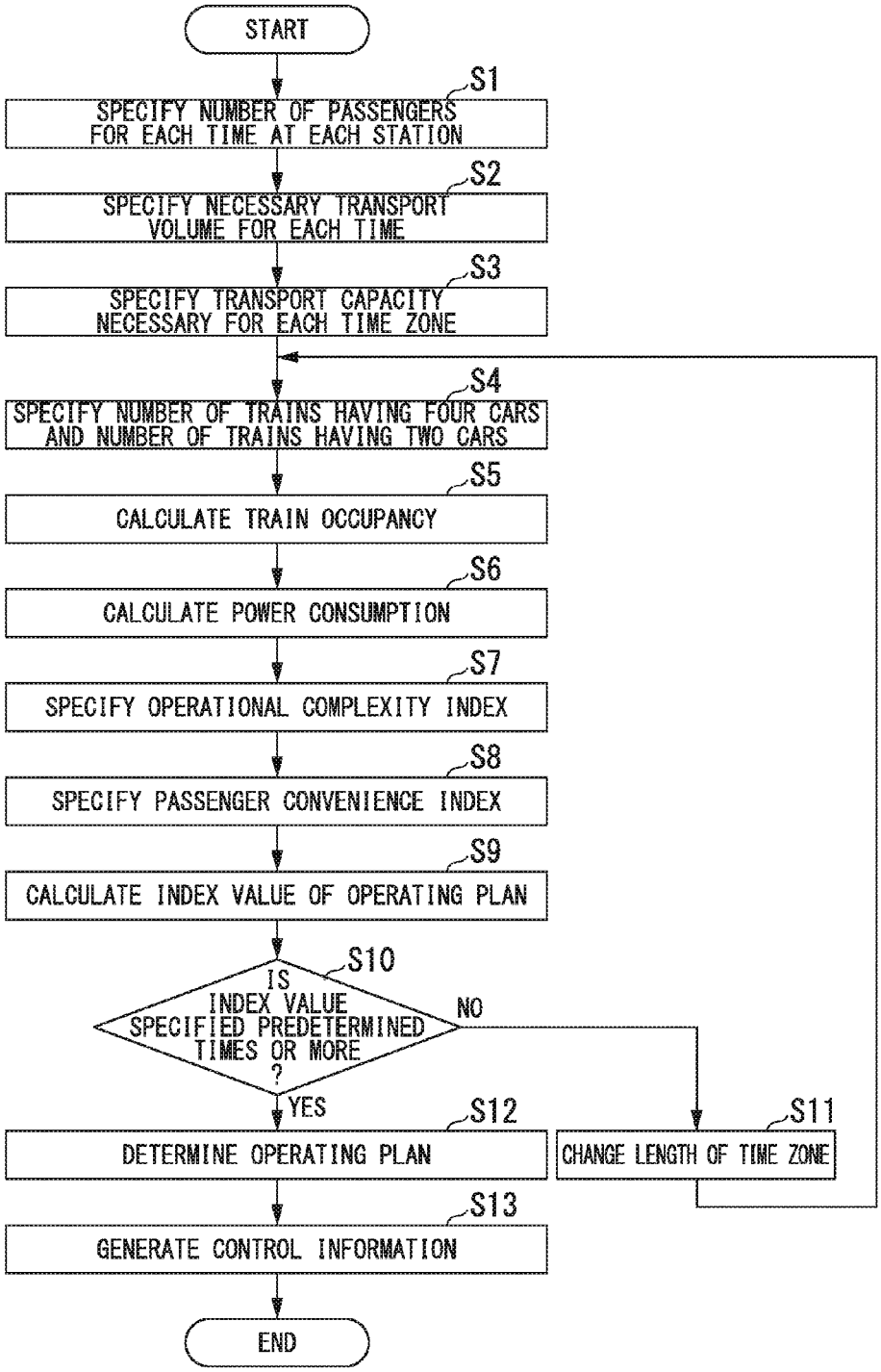
FIG. 2 is a flowchart illustrating an operational flow of a service management device according to the first embodiment.

FIG. 2 is a flowchart illustrating an operation of the service management device 20 according to the first embodiment.

Figure 3:
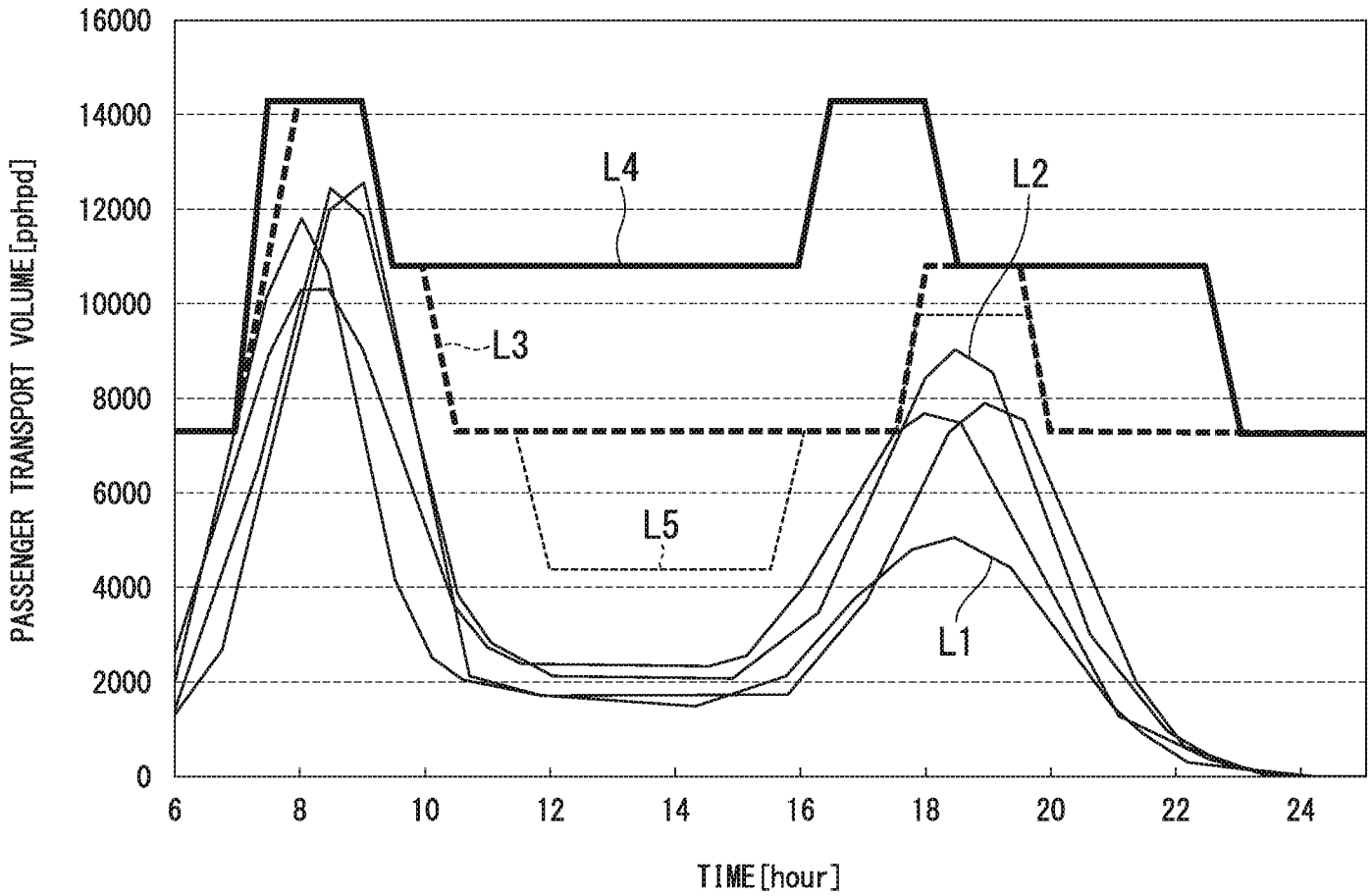
FIG. 3 is a diagram illustrating an image of an operating plan composing step according to the first embodiment.

FIG. 3 is a diagram illustrating a relationship between the necessary transport volume and the transport capacity for each time.

The service management device 20 composes an operating plan of a day before starting an operation of an originating train.

First, the necessary transport volume specifying unit 23 specifies the number of passengers for each station at each time of a day on which an operating plan is composed on the basis of data associated with a previous operation of the trains 10 recorded on the operating history database 22 (step S1). A line group L1 illustrated in FIG. 3 represents a variation in the number of passengers for each time at each station. Then, the necessary transport volume specifying unit 23 specifies a necessary transport volume on the basis of a maximum number of passengers at each time (step S2). The necessary transport volume in this embodiment is calculated on the basis of a value which is obtained by adding a margin which permits fluctuation of the number of passengers to the maximum number of passengers at each time. A line L2 illustrated in FIG. 3 represents a variation of the necessary transport volume.

Then, the operational cars determining unit 24 specifies a transport capacity (an off-peak transport capacity, a normal transport capacity, or a peak transport capacity) required for each time zone on the basis of the necessary transport volume specified by the necessary transport volume specifying unit 23 (step S3). That is, the operational cars determining unit 24 determines the number of operational cars and an operating interval for each time zone on the basis of the necessary transport volume specified by the necessary transport volume specifying unit 23. A line L3 illustrated in FIG. 3 represents a variation in transport capacity depending on the number of operational cars. The line L3 represents the transport capacity when all the trains 10 operate having four cars (the maximum number of operational cars in the transport system 1). A line L4 illustrated in FIG. 3 represents a standard operating plan which is generated regardless of the service management device 20. In FIG. 3, the transport capacity associated with the number of operational cars determined by the operational cars determining unit 24 is smaller than the transport capacity associated with the standard operating plan.

In FIG. 3, the transport capacity associated with the number of operational cars determined by the operational cars determining unit 24 is normally larger than the necessary transport volume. That is, the operational cars determining unit 24 can secure the transport capacity capable of transporting the necessary transport volume and reduce an excessive number of operational cars.

Then, the valid cars determining unit 25 determines the number of trains 10 having four cars and the number of trains 10 having two cars on the basis of Equation (1) for each time zone when one day is divided into a plurality of time zones (step S4). A line L5 illustrated in FIG. 3 represents a variation in transport capacity based on the number of valid cars determined by the valid cars determining unit 25. In FIG. 3, the transport capacity associated with the number of valid cars determined by the valid cars determining unit 25 is smaller than the transport capacity when all the trains 10 run having four cars. On the other hand, in FIG. 3, the transport capacity associated with the number of valid cars determined by the valid cars determining unit 25 is normally larger than the necessary transport volume. That is, the valid cars determining unit 25 can reduce an excessive transport capacity without changing the number of operational cars.

Then, the index value specifying unit 26 calculates a train occupancy when the trains 10 having four cars and the trains 10 having two cars operate at the number of valid cars determined by the valid cars determining unit 25 for each time zone (step S5). The index value specifying unit 26 can calculate the train occupancy by dividing the necessary transport volume specified in step S2 by a transport capacity of the trains 10. The transport capacity of the trains 10 can be calculated by multiplying the total number of valid cars of the trains 10 running in the time zone by the maximum number of passengers per car.

Then, the index value specifying unit 26 calculates power consumption of one day on the basis of the calculated train occupancy (step S6). Specifically, the index value specifying unit 26 can calculate the power consumption of one day by calculating power consumption $P_t$ using Equation (2) for each time zone t and calculating the total sum thereof.

[Math. 2]

$$P_t = \frac{W_t}{W_{full}} V_t \alpha \tag{2}$$

$W_t$ denotes a car weight in the time zone t. The car weight $W_t$ is a value obtained by adding an empty car weight to a value obtained by multiplying a passenger weight of a full car by a train occupancy in the time zone t calculated in step S5. $W_{full}$ denotes a full car weight. The full car weight $W_{full}$ is a value obtained by adding an empty car weight to the passenger weight of the full car. $V_t$ denotes the total sum of the numbers of cars of the trains 10 running in the time zone t (which includes cars other than the valid cars included in the trains 10). In addition, $\alpha$ is a coefficient indicating a relationship between car weight and power consumption. The coefficient $\alpha$ is a value pre-calculated by simulation or in-situ testing.

Then, the index value specifying unit 26 specifies a value which is obtained by adding a value obtained by multiplying a changing frequency of the number of valid cars determined by the valid cars determining unit 25 by a predetermined coefficient and a value obtained by multiplying a changing frequency of a schedule by a predetermined coefficient as an operational complexity index (step S7). The changing frequency of the number of valid cars is the number of times in which a combination of the number of trains having four cars and the number of trains having two cars is changed. The changing frequency of a schedule is the number of times in which the number of operational cars is changed per unit time.

Then, the index value specifying unit 26 specifies a sum of a value obtained by multiplying an average of the train occupancy calculated in step S5 by a predetermined coefficient and a value obtained by multiplying an average of the operating interval determined in step S3 by a predetermined coefficient as a passenger convenience index (step S8). Then, the index value specifying unit 26 calculates a sum of values obtained by multiplying the calculated power consumption, the operational complexity index, and the passenger convenience index by weighting coefficients, respectively, as an index value of the operating plan (step S9). The weighting coefficients of the calculated car weight, the operational complexity index, and the passenger convenience index are appropriately set by a manager of the transport system 1. For example, when power consumption or passenger convenience is thought to be more important than operational complexity, the manager sets the weighting coefficient of the operational complexity index to be lower and sets the weighting coefficients of the power consumption and the passenger convenience index to be higher.

Then, the operating plan determining unit 28 determines whether the index value has been specified a predetermined number of times or more by the index value specifying unit 26 (step S10). When the operating plan determining unit 28 determines that the index value has been specified less than the predetermined number of times by the index value specifying unit 26 (NO in step S10), the time zone changing unit 27 changes a length of the time zone serving as a reference in the calculation of the number of valid cars by the valid cars determining unit 25 (step S11). The longer the length of the time zone is, the less opportunity for changing the number of valid cars, and thus the lower the operational complexity. Then, the service management device 20 redetermines the number of valid cars for each changed time zone in step S4.

On the other hand, when the operating plan determining unit 28 determines that the index value has been specified a predetermined number of times or more by the index value specifying unit 26 (YES in step S10), a combination in which the index value specified by the index value specifying unit 26 is a minimum among combinations of the trains 10 determined by the valid cars determining unit 25 is determined to be an operating plan of the day (step S12). Accordingly, the operating plan determining unit 28 can generate an operating plan with a balance among power consumption, operational complexity, and passenger convenience. The control information generating unit 29 generates control information of the trains 10 and the stations on the basis of the operating plan determined by the operating plan determining unit 28 (step S13). The control information of the trains 10 includes information of departure times of the stations. Since platform screen doors are changed depending on the number of operational cars of the trains 10, the control information of the stations include control information of the platform screen doors. Since a station employee notifies passengers at what positions of the platform the cars stop depending on the number of operational cars of the trains 10, the control information of the stations include passenger guidance information. The control information generating unit 29 transmits the generated control information to the trains 10 and the station managing device 40.

As a result, the trains 10 operate in accordance with the operating plan generated by the service management device 20. As described above, the number of operational cars of the trains 10 in the operating plan may be changed. An example of a method of changing the number of operational cars will be described below. Examples of a method of changing the train 10 having four cars to the train 10 having two cars include a method of changing the train 10 to have two cars by separating two cars from the train 10 and a method of replacing the train 10 having four cars with the train 10 having two cars stored in a garage of an originating station. Similarly, examples of the method of changing the train 10 having two cars to a train having four cars include a method of changing the train 10 to have four cars by additionally connecting two cars to the train 10 and a method of replacing the train 10 having two cars with the train 10 having four cars stored in the garage of the originating station.

[Effects]

According to this embodiment, the transport system 1 determines the number of operational cars of each train 10 for each time such that the operating interval of the trains 10 is normally equal to or less than the minimum operating interval. Accordingly, the transport system 1 can prevent damage of passenger convenience by suppressing the waiting times of passengers to be less than the minimum operating interval. The transport system 1 determines the number of operational cars of each train 10 such that the passenger transport volume is not less than the necessary transport volume and the total number of operational cars is minimized on the basis of the determined number of operational cars. Accordingly, the transport system 1 can improve operation efficiency of the trains 10.

Figure 4A:
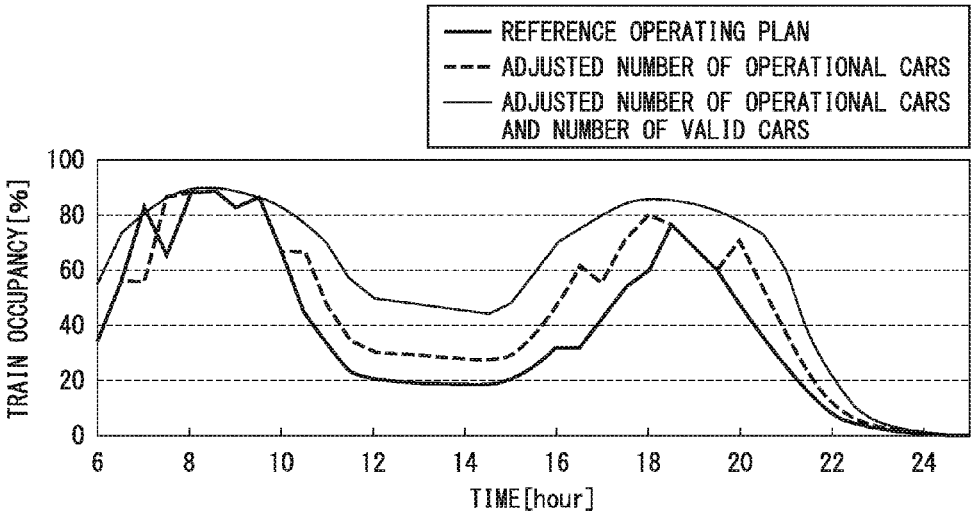
FIG. 4A is a diagram illustrating effects of the transport system according to the first embodiment.
Figure 4B:
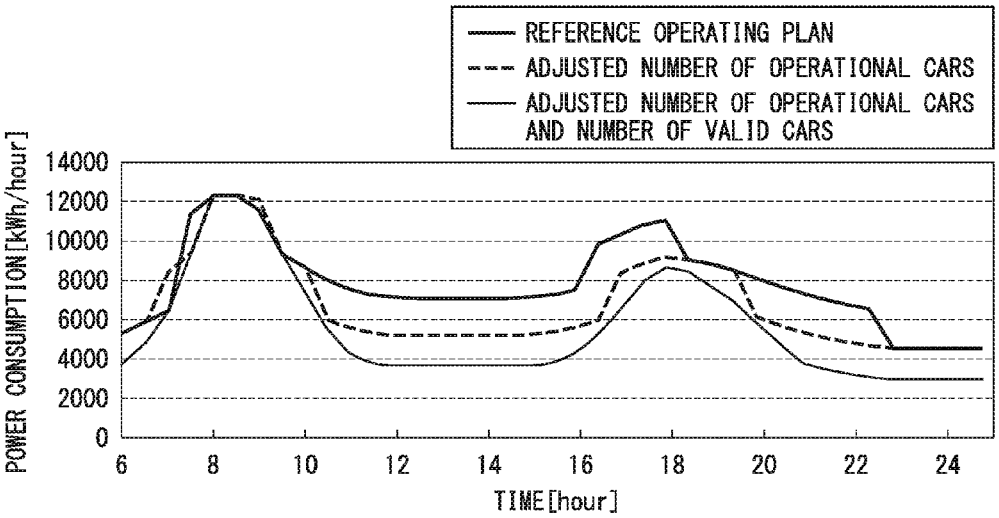
FIG. 4B is a diagram illustrating effects of the transport system according to the first embodiment.

FIGS. 4A and 4B are diagrams illustrating effects of the first embodiment.

FIG. 4A is a diagram illustrating a variation in train occupancy of the trains 10 for each time. FIG. 4B is a diagram illustrating a variation in power consumption of the trains 10 for each time.

As illustrated in FIGS. 4A and 4B, it can be seen that, by causing the trains 10 to operate with the number of operational cars determined by the operational cars determining unit 24, the train occupancy of the trains 10 is improved and the power consumption is reduced in comparison with a case in which the trains 10 operate on the basis of a reference operating plan. It can be seen that, by changing the number of operational cars of each train 10 depending on the number of valid cars determined by the valid cars determining unit 25, the train occupancy of the trains 10 is further improved and the power consumption is further reduced in comparison with a case in which only the number of operational cars is changed.

According to this embodiment, the transport system 1 determines an operating plan in which the index value which is a sum of values obtained by multiplying the power consumption, the operational complexity index, and the passenger convenience index by the weighting coefficients is the smallest as an operating plan of a day. Accordingly, the transport system 1 can cause the trains 10 to operate in accordance with an operating plan with a balance among operation efficiency, operational complexity, and passenger convenience.

Second Embodiment

A second embodiment will be described below.

The transport system 1 according to the first embodiment changes the number of operational cars of each train 10 on the basis of the number of valid cars determined by the valid cars determining unit 25. On the other hand, the transport system 1 according to the second embodiment does not change the number of operational cars of each train 10. The process of changing the number of operational cars of each train 10 requires connection or disconnection of cars or entrance and exit of trains 10 with respect to a garage. Accordingly, when a changing frequency of the number of operational cars is high, the operation is complicated. Therefore, the transport system 1 according to this embodiment simplifies the operation by not changing the number of operational cars depending on the number of valid cars.

Figure 5:
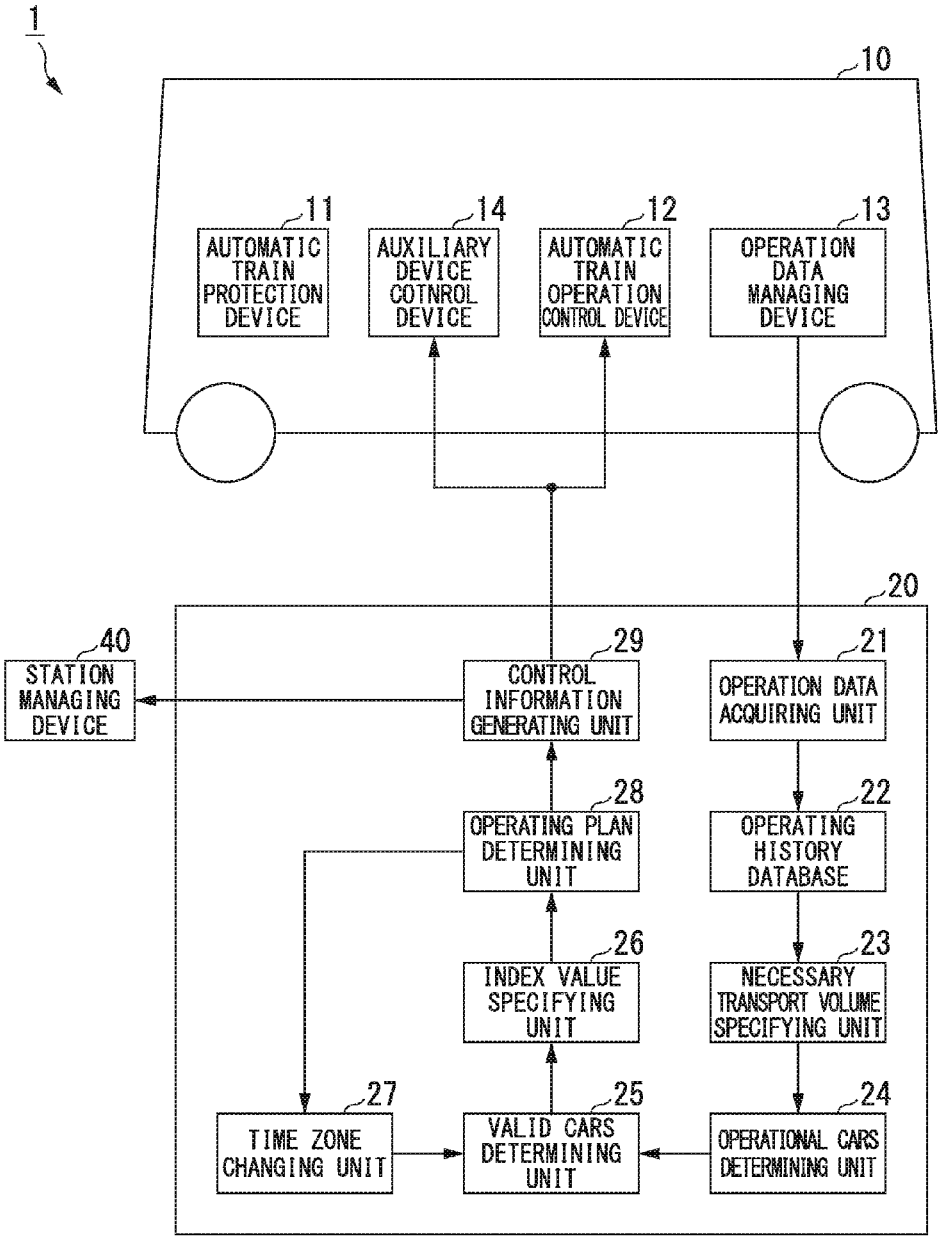
FIG. 5 is a schematic diagram illustrating a configuration of a transport system according to a second embodiment.

FIG. 5 is a schematic block diagram illustrating a configuration of the transport system 1 according to the second embodiment.

In the transport system 1 according to the second embodiment, the control information generating unit 29 generates control information associated with auxiliary devices of the trains 10. In the transport system 1 according to the second embodiment, an auxiliary device control device 14 of each train 10 operates on the basis of the control information.

The auxiliary device control device 14 controls the operation of the auxiliary devices of each train 10. Examples of an auxiliary device include an air-conditioner and a door opening/closing device.

The control information generating unit 29 generates control information for not supplying auxiliary device power to two cars on the rearmost side among the cars of the train 10 when the number of valid cars of the train 10 is changed from four to two. Accordingly, the transport system 1 stops the auxiliary devices of the cars other than the valid cars in the train 10 having cars more than the number of valid cars determined by the valid cars determining unit 25. Accordingly, two cars on the front side among the cars of the train 10 are valid cars. Passengers cannot board two cars on the rearmost side among the four cars of the train 10. Similarly, the control information generating unit 29 generates control information for supplying auxiliary device power to all cars among the cars of a train 10 when the number of valid cars of the train 10 is changed from two to four. Accordingly, all of the four cars of the train 10 are valid cars.

According to this embodiment, the running trains 10 normally have four cars (the maximum number of operational cars in the transport system 1). Accordingly, the power consumption is higher than that in the first embodiment. On the other hand, at least power consumption corresponding to the supply of auxiliary device power of cars other than the valid cars is reduced.

According to this embodiment, the number of operational cars of the train 10 is not changed depending on the number of valid cars. Accordingly, the transport system 1 can simplify its operation.

[Review]

While embodiments have been described above in detail with reference to the drawings, a specific configuration is not limited to the above-mentioned configurations but can be subjected to various modifications in design and the like.

For example, the service management device 20 according to the above-mentioned embodiments determines both the number of operational cars and the number of valid cars on the basis of the necessary transport volume, but the present invention is not limited to this configuration. For example, the service management device 20 according to another embodiment may not change the number of operational cars from the reference operating plan but may determine only the number of valid cars of each train 10 on the basis of the necessary transport volume. In this case, the transport system 1 can also improve the operation efficiency of the trains 10 without increasing the waiting times of passengers in comparison with the reference operating plan.

The transport system 1 according to the above-mentioned embodiments selects the number of operational cars of each train 10 from two types of two cars and four cars, but the present invention is not limited to this configuration. For example, in another embodiment, three or more types of patterns of the number of operational cars of each train 10 may be employed. In another embodiment, the patterns of the number of operational cars of each train 10 may not be predetermined.

In the above-mentioned embodiments, a necessary boarding and alighting time specifying unit 23 specifies the necessary boarding and alighting time on the basis of the information stored in the operating history database 22, but the present invention is not limited to this configuration. A ticket gate of each station can specify a boarding station and an alighting station from a ticket or a commuting ticket. For example, in another embodiment, the train occupancy may be specified on the basis of the number of passengers boarding and alighting at each station which is specified by data collected by the ticket gates of the stations.

The transport system 1 according to the first embodiment changes the number of operational cars of each train 10 and the transport system 1 according to the second embodiment does not change the number of operational cars of each train 10 but changes supply of the auxiliary device power, but the present invention is not limited to these configurations. For example, the transport system 1 according to another embodiment may select a configuration for changing the number of operational cars of each train 10 or a configuration for not changing the number of operational cars but changing supply of the auxiliary device power so as to decrease the index value specified by the index value specifying unit 26.

Figure 6:
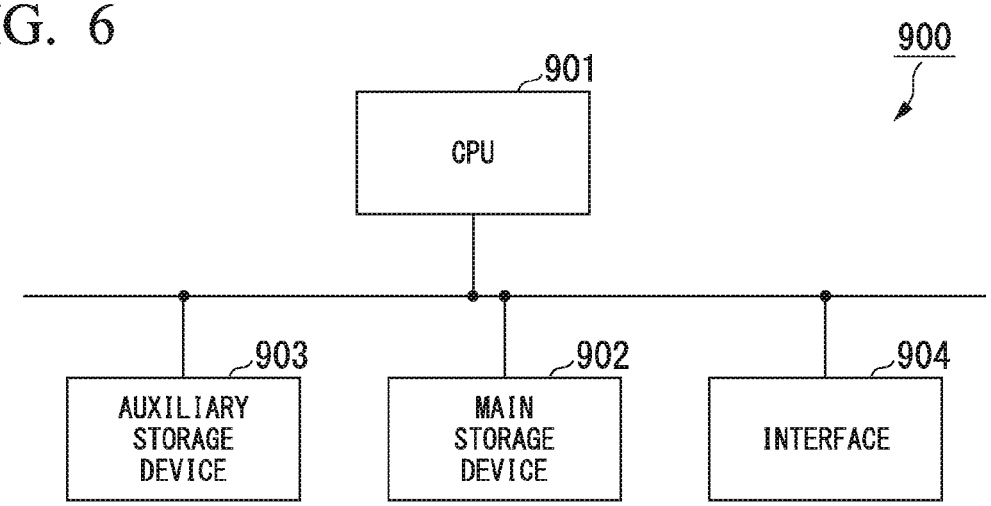
FIG. 6 is a schematic block diagram illustrating a configuration of a computer according to at least one embodiment.

FIG. 6 is a schematic block diagram illustrating a configuration of a computer 900 according to at least one of the above-mentioned embodiments.

The computer 900 includes a central processing unit (CPU 901), a main storage device 902, an auxiliary storage device 903, and an interface 904.

The service management device 20 is mounted on the computer 900. The operations of the above-mentioned processing units are stored in the form of a program in the auxiliary storage device 903. The CPU 901 reads the program from the auxiliary storage device 903 and loads the program into the main storage device 902. The CPU 901 performs the above-mentioned processes in accordance with the program.

In at least one of the above-mentioned embodiments, the auxiliary storage device 903 is an example of a non-transitory medium. Other examples of the non-transitory medium include a magnetic disk, a magneto-optical disk, a compact disc read-only memory (CD-ROM), a digital versatile disc (DVD)-ROM, and a semiconductor memory which are connected thereto via the interface 904. When the program is transmitted to the computer 900 via a communication line, the computer 900 receiving the program may load it into the main storage device 902 and perform the above-mentioned processes.

The program may serve to realize a part of the above-mentioned functions. The program may be a so-called differential file (a differential program) which realizes the above-mentioned functions in combination with another program stored in the auxiliary storage device 903.

INDUSTRIAL APPLICABILITY

The service management device determines the number of valid cars of each train such that a passenger transport volume per unit time is not less than a necessary transport volume and the total number of valid cars is minimized.

Accordingly, the service management device can improve train operation efficiency without damaging passenger convenience.

REFERENCE SIGNS LIST

1 Transport system
10 Train
11 Automatic train protection device
12 Automatic train operation control device
13 Operation data managing device
14 Auxiliary device control device
20 Service management device
21 Operation data acquiring unit
22 Operating history database
23 Necessary transport volume specifying unit
24 Operational cars determining unit
25 Valid cars determining unit
26 Index value specifying unit
27 Time zone changing unit
28 Operating plan determining unit
29 Control information generating unit
40 Station managing device
900 Computer
901 CPU
902 Main storage device
903 Auxiliary storage device
904 Interface

The invention claimed is:

1. A service management device comprising:

a valid cars determining unit configured to determine the number of valid cars of each train operating for each predetermined time zone such that a passenger transport volume per unit time of a plurality of trains is not less than a necessary transport volume and the total number of valid cars is minimized when a plurality of trains having one or more cars run with a predetermined number of operational cars per unit time;

an index value specifying unit configured to specify an index value on the basis of the number of valid cars determined by the valid cars determining unit, the index value becoming larger as a changing frequency of the number of valid cars increases or becoming larger as an occupancy of the valid cars and a waiting time of passengers increase;

a time zone changing unit configured to change a length of a time zone which serves as a reference in a calculation of the number of valid cars by the valid cars determining unit;

an operating plan determining unit configured to determine the number of valid cars of each train to the number of valid cars having the smallest index value; and a control information generating unit configured to generate control information for performing control which causes trains having valid cars corresponding to the number of valid cars determined by the operating plan determining unit to operate at a predetermined interval.

2. The service management device according to claim 1, further comprising an operational cars determining unit configured to determine the number of operational cars per unit time on the basis of the necessary transport volume, wherein the valid cars determining unit is configured to determine the number of valid cars of each train on the basis of the number of operational cars which is determined by the operational cars determining unit.

3. The service management device according to claim 2, wherein the operational cars determining unit configured to determine the number of operational cars to be a predetermined minimum value or more.

4. The service management device according to claim 1, further comprising a necessary transport volume specifying unit configured to specify the necessary transport volume on the basis of data associated with a previous operation.

5. The service management device according to claim 1, wherein the index value specifying unit is configured to specify an index value which increases as energy consumption increases when the trains run and which increases as a changing frequency of the number of valid cars increases on the basis of the number of valid cars determined by the valid cars determining unit.

6. The service management device according to claim 1, wherein the valid cars determining unit is configured to determine the number of valid cars of each train from a predetermined valid car pattern.

7. A train control method comprising the steps of:

determining the number of valid cars of each train operating for each predetermined time zone such that a passenger transport volume per unit time of a plurality of trains is not less than a necessary transport volume and the total number of valid cars is minimized when a plurality of trains having one or more cars run with a predetermined number of operational cars per unit time;

specifying an index value on the basis of the determined number of valid cars;

changing a length of the time zone which serves as a reference in calculating the number of valid cars, the index value becoming larger as a changing frequency of the number of valid cars increases or becoming larger as an occupancy of the valid cars and a waiting time of passengers increase;

determining the number of valid cars of each train to the number of valid cars having the smallest index value; and generating control information for performing control which causes trains having valid cars corresponding to the determined number of valid cars to operate at a predetermined interval.

8. The train control method according to claim 7, further comprising a step of stopping an auxiliary device of a car other than the valid cars in the train having more than the determined number of valid cars.

9. A program causing a computer to serve as:

a valid cars determining unit configured to determine the number of valid cars of each train operating for each predetermined time zone such that a passenger transport volume per unit time of a plurality of trains is not less than a necessary transport volume and the total number of valid cars is minimized when a plurality of trains having one or more cars run with a predetermined number of operational cars per unit time;

an index value specifying unit configured to specify an index value on the basis of the number of valid cars determined by the valid cars determining unit, the index value becoming larger as a changing frequency of the number of valid cars increases or becoming larger as an occupancy of the valid cars and a waiting time of passengers increase;

a time zone changing unit configured to change a length of the time zone which serves as a reference in a calculation of the number of valid cars by the valid cars determining unit;

an operating plan determining unit configured to determine the number of valid cars of each train to the number of valid cars having the smallest index value; and a control information generating unit configured to generate control information for performing control which causes trains having valid cars corresponding to the number of valid cars determined by the operating plan determining unit to operate at a predetermined interval.

* * * * *